US006336225B1

(12) United States Patent
Bowlby

(10) Patent No.: US 6,336,225 B1
(45) Date of Patent: Jan. 8, 2002

(54) ADJUSTABLE SIDE SADDLE RIDING HABIT

(76) Inventor: Linda A. Bowlby, 5619 SR 19, Bucyrus, OH (US) 44820

( * ) Notice: Subject to any disclaimer, the term of this patent is extended or adjusted under 35 U.S.C. 154(b) by 0 days.

(21) Appl. No.: 09/562,414

(22) Filed: May 1, 2000

(51) Int. Cl.[7] ..... A41D 1/14
(52) U.S. Cl. ..... 2/214
(58) Field of Search ..... 2/214, 211, 219, 2/220, 231, 338

(56) References Cited

U.S. PATENT DOCUMENTS

| | | | | |
|---|---|---|---|---|
| 320,954 A | | 6/1885 | Muller | |
| 346,006 A | | 7/1886 | Williamson | |
| 443,587 A | | 12/1890 | Ulrich | |
| 445,203 A | * | 1/1891 | Rossberg | 2/231 |
| 579,471 A | | 3/1897 | Childe | |
| 610,032 A | | 8/1898 | Cottrelly | |
| 632,592 A | | 9/1899 | Skelton | |
| 1,371,307 A | | 3/1921 | Hertz | |
| 2,636,180 A | | 4/1953 | Gillespie et al. | |
| 5,566,397 A | * | 10/1996 | Scott | 2/338 |

FOREIGN PATENT DOCUMENTS

| | | |
|---|---|---|
| GB | 365 | 11/1890 |
| GB | 22468 | 10/1897 |

OTHER PUBLICATIONS

"The Horsewoman A Practical Guide to Side–Saddle Riding and Hunting, Hurst and Blackett Limited, 1910, Third Edition Revised and Enlarged", pp. 109–121, by Alice M. Hayes.

"The Twentieth Century System of Ladies' Garment Cutting", Minster and Company Limited, London, Fourth Edition, pp. 242–249, by J.C. Hopkins.

"The Direct System of Ladies' Cutting", R.L. Shep Publications, Third Edition Revised and Enlarged, pp. 104–112, published 1897—reprint published in 1997, by T.H. Holding.

"Side–Saddle Riding for Beginners" by Charlotte Brailey Kneeland, illustrated by Jan Olson Floyd, pp. 43, published in 1994.

"Modern Side–Saddle Riding, A Practical Handbook for Horsewomen", Vinton & Co., Limited, London, Third Edition Revised, pp. 94–99 and pp. 6–9, by Eva Christy, published 1907.

"Munk's Complete Specification", No. 7802, published Apr. 2, 1904.

"Busvine's Complete Specification", No. 17,301, published Sep. 14, 1893.

"Hart's Complete Specification", No. 14,617, published Jul. 1, 1903.

* cited by examiner

*Primary Examiner*—John J. Calvert
*Assistant Examiner*—Alissa L. Hoey
(74) *Attorney, Agent, or Firm*—Reinhart, Boerner, Van Deuren, Norris & Rieselbach, s.c.

(57) ABSTRACT

An improved side saddle riding skirt is disclosed. The improved side saddle riding skirt includes a knee loop coupled to a knee dart of the skirt, and a strap coupled to the hem of the skirt. This strap is removably coupled through the knee loop to prevent the skirt from flying up. The side saddle riding habit further includes mechanisms for adjusting the skirt to a range of different sizes.

21 Claims, 7 Drawing Sheets

FIG. 9
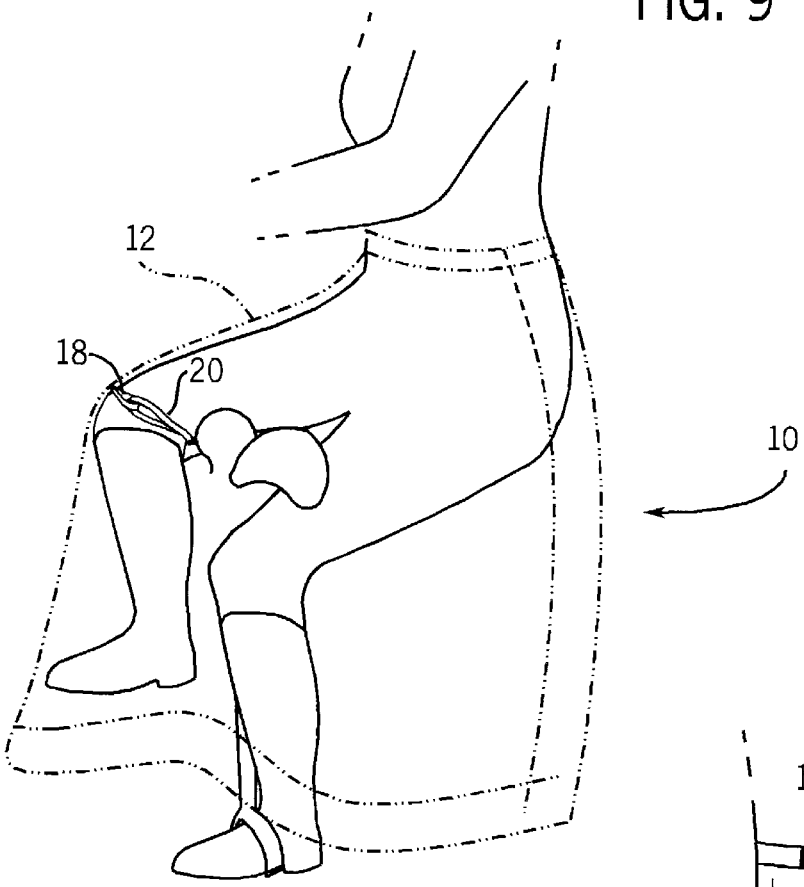
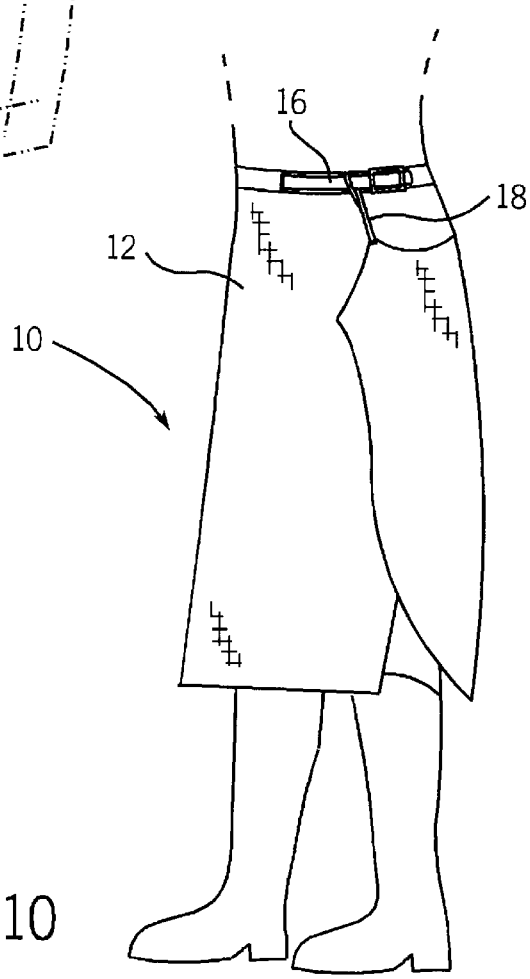
FIG. 10

ADJUSTABLE SIDE SADDLE RIDING HABIT

FIELD OF THE INVENTION

The present invention is related to side saddle riding habits. More particularly, the present invention relates to a side saddle riding apron which is flexible and convenient for modem riders and can be adjusted for use by riders of a number of different sizes.

BACKGROUND

Although women have been riding side saddle for centuries, clothing appropriate for use with the side saddle has always been problematic. Riding habits for side saddle riding must be capable of preventing a long skirt from flying up as the horse is in motion, while allowing the rider sufficient flexibility to control the horse and to dismount quickly in the event of an accident. To meet these needs, a number of different types of riding habits have been developed over the years.

One type of riding habit is disclosed in U.S. Pat. No. 445,203 to Rossberg. Rossberg discloses a riding habit that includes two flaps that button around the right leg and two elastic stirrups, one for each foot. The flaps maintain the skirt against the right leg, while the stirrups provide support for the feet while riding. Other prior art riding habits include various means for maintaining the skirt in proper order while seated on the horse. For example, in some cases buttons are sewn on internal breeches which can be buttoned to the inner facing of the skirt. In other cases, straps including button holes can fasten the edge of the skirt to internal buttons. In one particular case, for example, a Y-shaped elastic piece was used to fastened to the knee dart in the skirt to internal buttons located at the hem of the skirt. This configuration prevented the skirt from "riding up". In more recent times, many skirts have been fitted with a long elastic strap that was wound through a buttonhole in the edge of the skirt, and then around the leg and foot of the rider.

While all of these prior art devices serve their intended purpose, to prevent the skirt from riding up or flying open while riding the horse, they suffer from a number of disadvantages. Internal buttons, for example, can be difficult to fasten and unfasten. Therefore, a significant amount of time and effort is required in preparing to mount the horse, and in reconfiguring the habit once the ride is over. Furthermore, because the rider's leg is closely fastened to an often heavy, inflexible outer skirt, it can be difficult for the rider to maneuver appropriately in the event of a fall or accident, or even to dismount. Similarly, an elastic band wound around a leg can be difficult to remove and can even become entangled in the saddle, in the reins, or with other pieces of the rider's clothing. Often, the devices used to secure the skirt can be torn off or easily ripped from the clothing. Additionally, because of the need to provide straps, stirrups and other fastening devices in the skirt, the skirt must often be sized very specifically to the individual. Therefore, prior art devices must generally be custom-made or produced in a large number of sizes to fit a variety of riders. Furthermore, although riding side saddle is increasingly popular both in historic reenactments and for general riding, women today are less inclined to submit to restrictive and complicated clothing than in the past.

Therefore, there remains a need for a side saddle riding habit which allows the rider to ride side saddle in comfort. The riding skirt would preferably be easy to put on and take off. The riding skirt would also be flexible, to allow the rider to respond appropriately in the event of an accident, and to dismount easily. The skirt would be sturdy in construction, and would not tear easily. Preferably, the skirt would easily adjust to walking after the horse has been dismounted. The skirt would preferably also be adjustable, and therefore easily fitted to riders in a variety of size categories.

SUMMARY OF THE INVENTION

The present invention is a side saddle riding apron constructed, in part, to provide increased flexibility and freedom of movement for the rider. A loop of material (the "knee loop") is coupled to or near a knee dart on the inside of the skirt. A strap coupled to an end of the skirt section of the apron can be removably attached around the leg of the rider and through the knee loop to retain the flap of the skirt against the right leg of the rider while riding, thereby preventing the skirt from "flying up." Because the leg is inhibited only by a small flexible strap, rather than buttoned to the side of the skirt or to internal breeches, the rider can move relatively freely during the ride. When the rider dismounts, the strap can be looped through a belt of the skirt, so that the rider can also walk comfortably. The knee loop and strap are preferably constructed of elastic, rubber, or other stretchable materials, thereby maximizing flexibility of movement. However, the loop and strap can also be constructed of cloth materials, string, rope, or other suitable substitutes.

In another aspect of the invention, the riding apron can be adjusted to fit riders in a variety of size categories. The knee dart described above, for example, can be varied in length, and the knee loop repositioned as appropriate to fit the height of the rider.

The riding apron can also include one or more size adjusters, such as belt buckles or slide fasteners, to adjust the waist of the skirt to fit riders of different sizes. One or more size adjusters are preferably located in the sides of the skirt, where they cannot be easily seen, and where they do not interfere with "centering" the long skirt section on the rider. If multiple size adjusters are used, they are preferably located at diametrically opposed positions on the skirt waist band to assure that the adjustment can be achieved without offsetting the center of the skirt. In one embodiment of the invention, for example, the first size adjuster is a belt buckle located on the right side of the skirt, and the second size adjuster is a slide fastener at the left side of the skirt. Although belt buckles and slide fasteners have been described, it will be apparent that the size adjusters can also be hook and loop fasteners, hook and eye fasteners, snaps, buttons, or other known types of fasteners.

To further adjust the size, the skirt can also include a fold-over section of material. The fold-over section can be folded under to reduce the waist of the skirt, or folded out to increase the waist of the skirt. The combination of the fold-over section and the size adjusters allows the waist of the skirt to be adjusted to a number of different sizes.

BRIEF DESCRIPTION OF THE DRAWINGS

FIG. 9 is an illustration of a rider wearing the riding apron of the present invention.

FIG. 10 is a view of a rider wearing the riding apron of the present invention while walking.

DETAILED DESCRIPTION OF THE PREFERRED EMBODIMENTS

Figure 1:
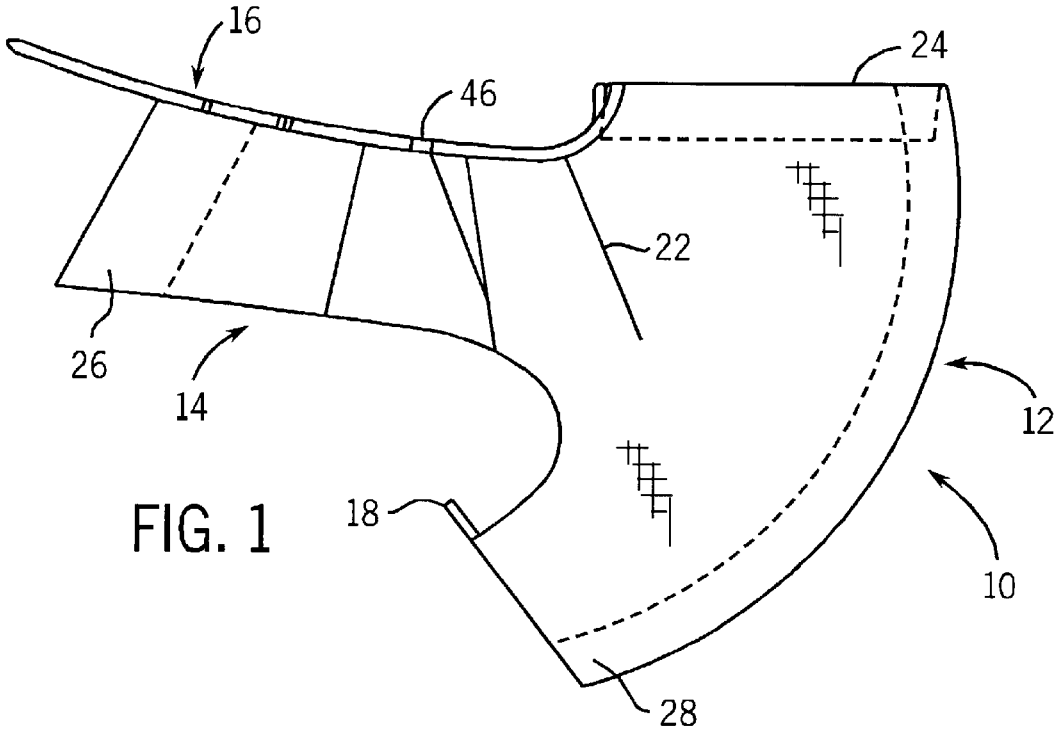
FIG. 1 is a plan view of a side saddle riding apron constructed in accordance with the present invention.
Figure 2:
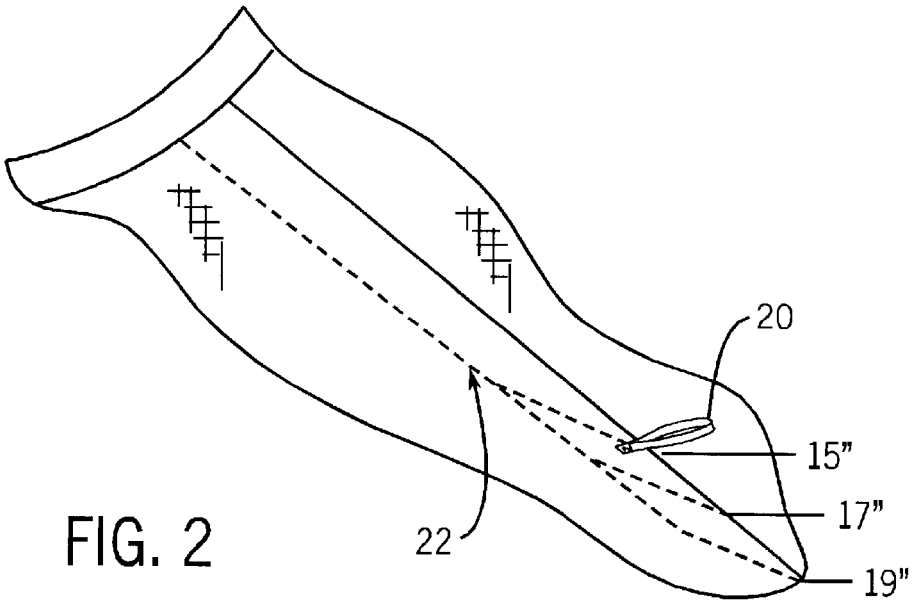
FIG. 2 is a close-up of the knee dart of the side saddle riding apron of FIG. 1.

Referring now to the Figures, and more particularly to FIG. 1, a riding apron constructed in accordance with one embodiment of the present invention is shown at 10. The riding apron includes a long front skirt section 12 and a shorter back section 14. The front skirt section 12 is intended to drape over the rider on the horse, while the back section 14 is relatively open to provide a better "seat" on the horse. This type of arrangement, therefore, is an "apron", rather than a full riding habit, although the features of the present invention could also be applied to a full riding habit. The front and back pieces are coupled to a belt 16, which can be adjustable as described below. A strap 18 is coupled to one end of the front skirt 12, and a knee loop 20 is coupled to a knee dart 22 on the inside of the skirt (FIG. 2). When riding, the strap 18 is removably coupled to the loop 20 to maintain the front skirt section 12 against the right leg of the rider while in motion, as described more fully below. Although front and back sections are described with respect to this embodiment of the invention, it will be apparent to one of ordinary skill in the art that, in the alternative, the apron can be cut from a single piece of cloth or other suitable material, or that the skirt could be constructed from a plurality of panels.

Figure 3:
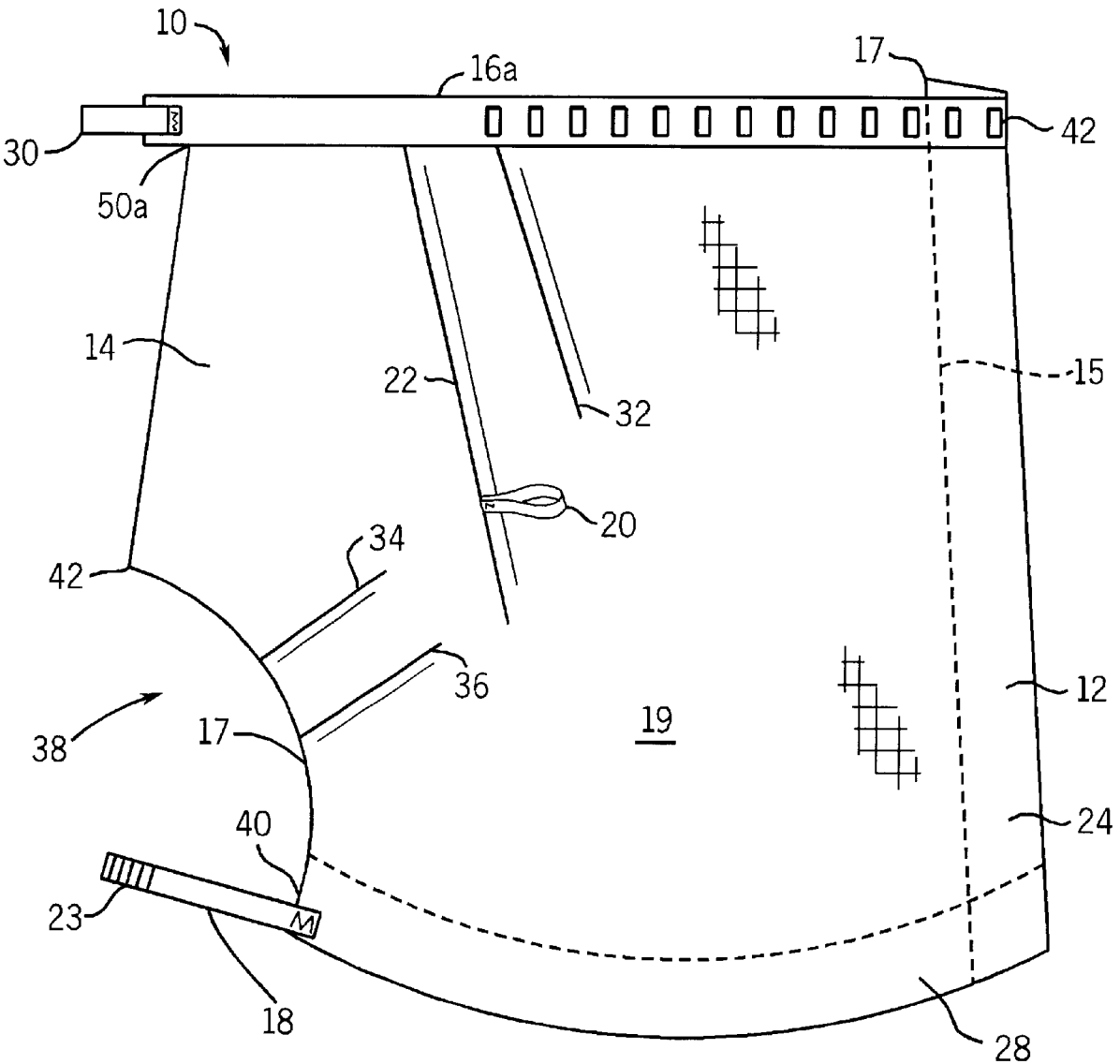
FIG. 3 is a plan view of a front skirt section of the side saddle riding apron of FIG. 1.

The front skirt section 12 of the riding skirt 10 is shown in detail in FIG. 3. The front section 12 includes a portion of the belt 16, here designated 16*a*, a hem 28, opposite the belt portion 16*a*, an outside edge 15, and an inside edge 17. A number of darts 22, 32, 34, and 36 are sewn into the front skirt section 12. The front skirt portion further comprises a fold over section 24 and a cut-away section 38. The knee loop 20, and the associated strap 18 are coupled to an internal side 19 of the front skirt section.

The front section 12 of the apron skirt 10 includes a number of means for adjusting the size of the waist of the skirt. In the embodiment of FIG. 3, the belt 16*a* includes a series of holes, designated generally as 42, which interact with a belt strap, described below, to adjust the waist of the skirt. A strap 30 can be added to the belt section 16*a* for use with a slide fastener, or other size adjuster. The fold over section 24, can be folded over or under to further adjust the waist of the skirt. The use of the described elements in adjusting the size of the skirt will be described in detail below.

The knee dart 22 combines with the plurality of darts 32, 34, and 36 to create a pocket for the knee of the rider in the riding apron 10 (a "knee pocket"), as is known in the art. The size and length of the knee pocket can be adjusted for a given rider by shortening or lengthening the knee dart 22 and by locating the knee loop 20 either closer to or farther from the belt 16, as required by the particular case (FIG. 2). Although the knee loop 20 is shown coupled to the knee dart 22, it will be apparent to one of ordinary skill in the art that the knee loop 20 can be coupled in any of a number of positions on the inside of the skirt 19 in or near the knee pocket.

The cut-away section 38 provides an opening for the pommel when the rider is seated on a side saddle, as is also known in the art. The knee pocket and cut-away sections are important features for forming the skirt to the rider as the rider is seated on the side saddle. The hem 28 is preferably lined with heavy felt or another material to cause the skirt to hang down appropriately and to help prevent "fly up."

The strap 18 is preferably coupled to an edge 40 of the cut-away section 38. The position of the strap, however, is limited only by the requirement that the skirt be maintained behind the rider while on the horse. Therefore, the strap 18 can be coupled to any of a number of positions on the front skirt section 12, preferably in a generally rectangular area bordered by the hem 28, the inside edge 17, and the cut-away section 38.

The strap 18 can be constructed of elastic rubber, plastic, cloth materials, string, thread, rope, or other known materials. In one embodiment, for example, the strap 18 comprises an elastic material, which can be folded through the knee loop 20 and fastened by means of a hook and loop type fastener 23. The hook and loop type fastener 23 is coupled to the strap 18, such that the strap can be engaged by folding the edge of the strap 18 over onto itself. Although there are obvious advantages to the hook and loop fastener 23, it will be apparent that other types of removable fasteners such as buttons, snaps, slide fasteners, and buckles could also be used. Furthermore, the strap 18 could be tied in a loop, rather than fastened with an additional fastening device.

Figure 4:
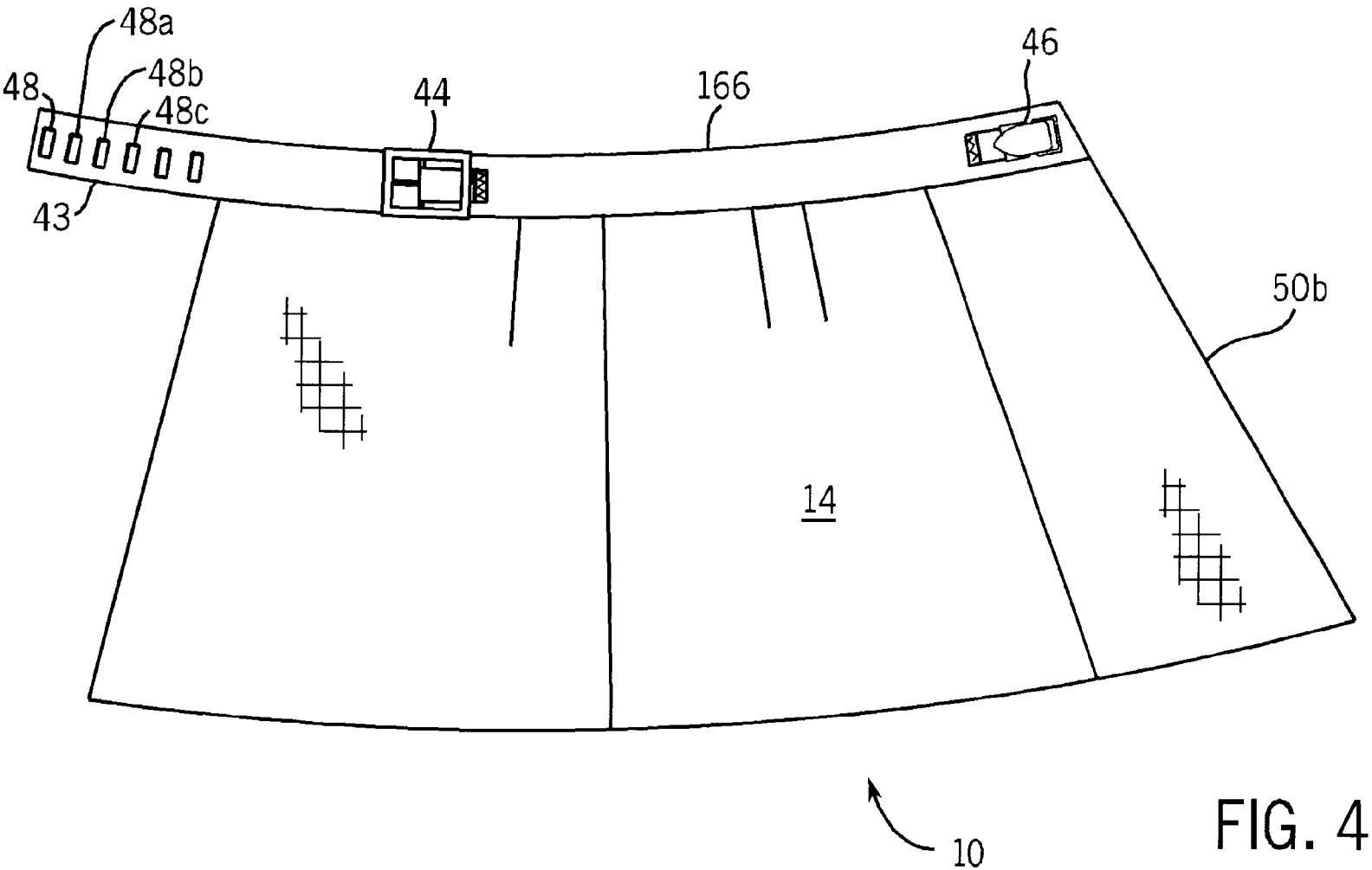
FIG. 4 is a plan view of a back skirt section of the side saddle riding apron of FIG. 1

Referring now to FIG. 4, the back section 14 of the riding apron 10 is shown. The back section 14 is cut shorter than the front section 12, since this part of the skirt is not seen when the rider is seated on the horse, and a longer skirt could interfere with the saddle and the rider. Like the front skirt section 12, the back section 14 includes a section of the belt 16, here designated 16*b*. In the embodiment shown in FIG. 4, the belt 16*b* includes a belt strap 43 and corresponding holes 48. Two size adjusters are also provided on the belt section 16*b*. The first size adjuster 44 can be a belt buckle, as shown. The second size adjuster 46 can be a slide fastener, as shown. However, it is apparent that a number of different types of adjusters including hook and loop fasteners, snaps, hook and eye adjustments, buttons, or other types of fasteners could be used for both the first and second size adjusters, either alone or in combination. Furthermore, although these adjusters are shown coupled to the back section, it is apparent that they could also be coupled to the front section 12 of the apron skirt 10. Additionally, although two size adjusters are shown, it will be apparent that one or more size adjusters could be used.

To assemble the skirt as shown in FIG. 1, the front section 12 is sewn or otherwise coupled to the back section 14. The seam preferably runs from the point 42 on the cutaway section 38 of the front skirt 12 to the points marked 50*a* (FIG. 3) on the front skirt section 12 and 50*b* (FIG. 4) on the back section 14. Because the seam is not sewn all of the way to the belt 16, the second size adjuster 46 can be expanded or retracted to adjust the waist of the skirt. For a small rider, for example, the strap 30 can be pulled fully into the slide adjuster 46 to shorten the skirt. On the other hand, a larger rider may elect to allow the slide adjust and strap to hang loose, thereby allowing the waist of the riding apron 10 to expand to its fullest extent.

Figure 5C:
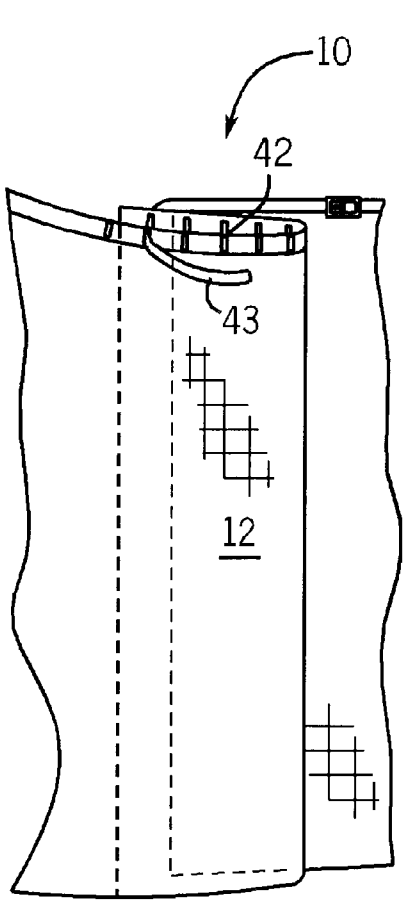
FIGS. 5A–5C are each a cutaway view of the side saddle riding apron of the present invention, illustrating steps in sizing and securing the skirt in a closed position.
Figure 5B:
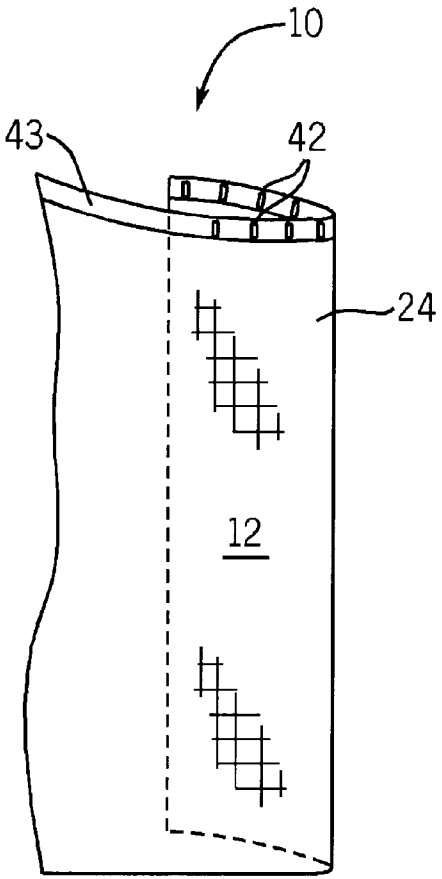
Figure 5A:
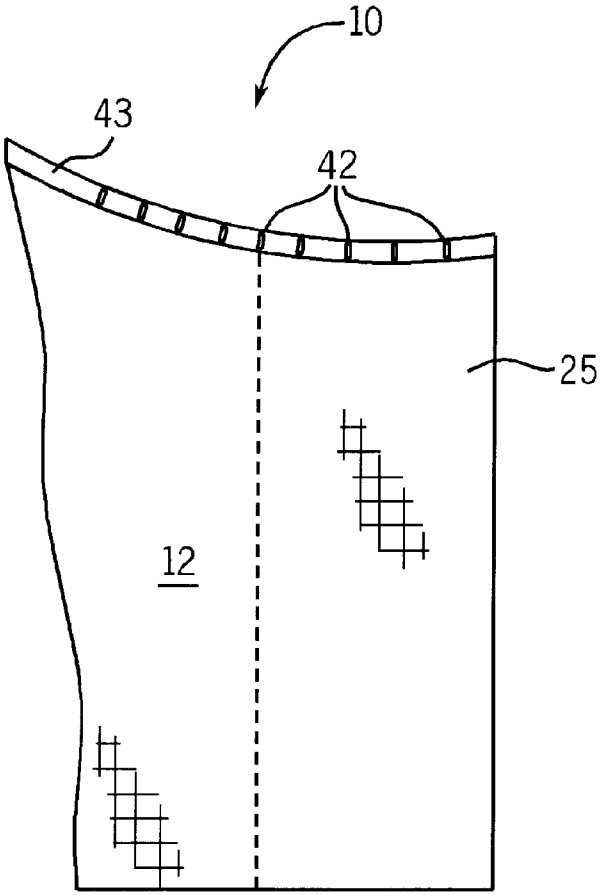

Referring now to FIGS. 5A–5C, the adjustment of the length of the waist of the riding apron 10 is shown. Initially, the rider will determine how wide the skirt needs to be to fit appropriately. This can be accomplished by trying the riding skirt 10 on in its fully extended state (i.e. without a folded section 24), through a visual check, by measuring the waist of the rider, or in a number of other ways. Once this measurement is complete, the rider can determine how large of a fold is required in order to fit the riding apron 10 to the rider's figure (FIG. 5A), and can fold the edge of the front skirt section 12 under to shorten the waist. In folding the skirt, the rider must align the holes 42 in the folded section 24 with the holes 42 in the front skirt 12 (FIG. 5B) such that the belt strap 43 can be fed through the hole (FIG. 5C). The belt strap 43 is then coupled to the belt buckle 44 to secure the skirt to the rider.

Figure 6:
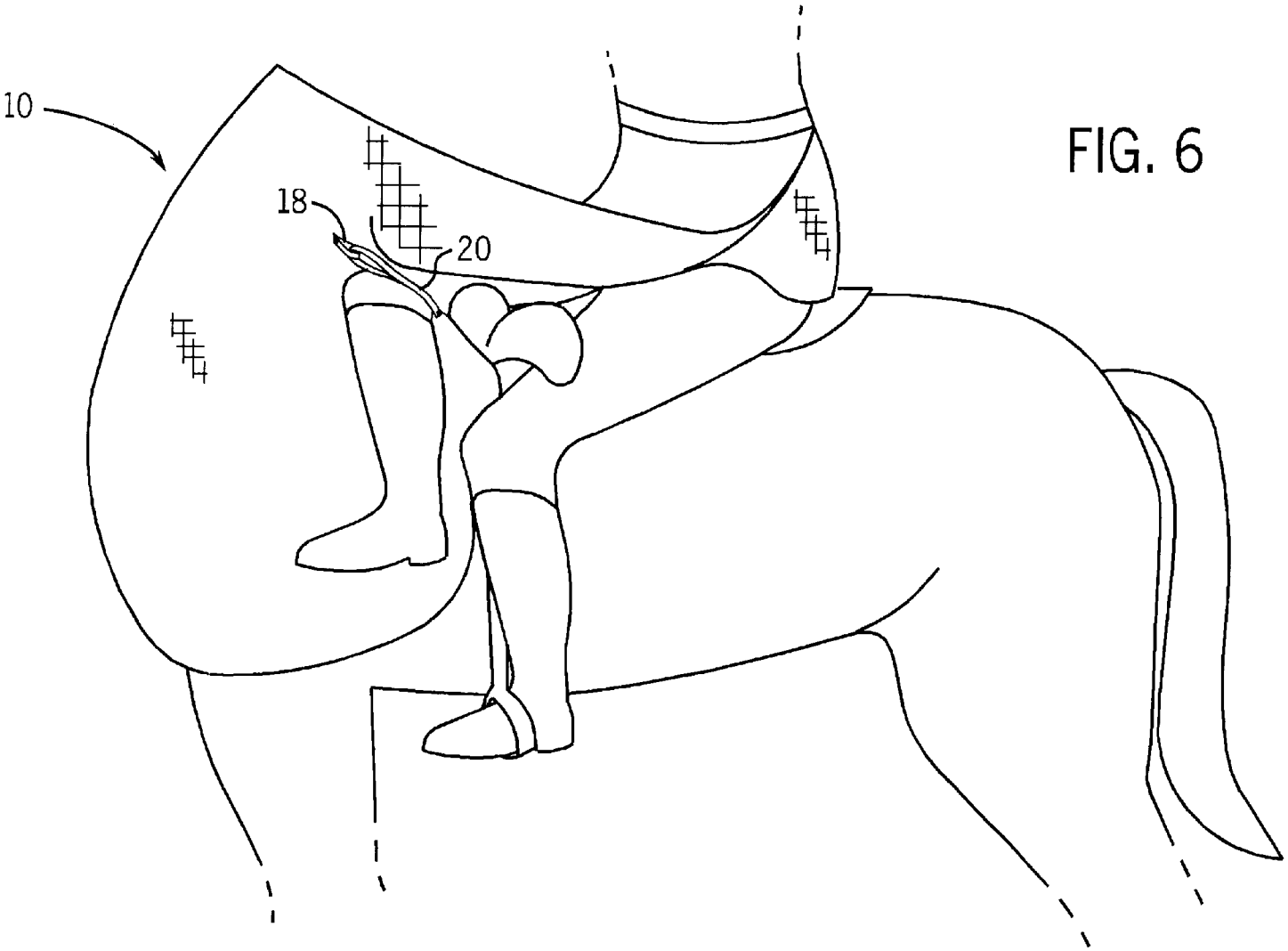
FIG. 6 is an illustration of a rider secured to the riding apron of the present invention.

Referring now to FIG. 6, a rider wearing the riding apron 10 is shown mounted on a side saddle. When mounted, the rider loops the strap 18 around the right leg, and through the knee loop 20 to secure the skirt in place. As described above, for example, the strap 18 can be looped around the leg, then through the knee loop 20. To secure the strap 18, it is preferably folded over onto a hook and loop type fastener 23, such as a piece of Velcro® sewn to the strap 18. The hook and loop type fastener 23 allows the rider to easily fasten the strap 18 to the knee loop 20 while riding. Furthermore, when the rider chooses to dismount, the strap 18 can be easily disconnected from the knee loop 20. Additionally, since the strap 18 easily connects the rider's leg to the skirt, the rider retains significant flexibility in movement as noted above. This flexibility is increased through the use of elastic for both the knee loop 20 and strap 18.

Figure 7:
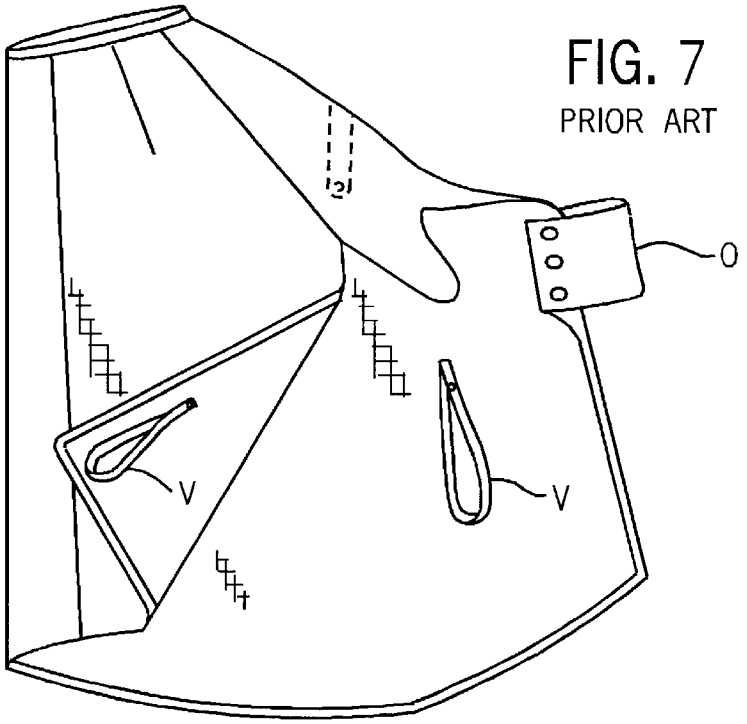
FIG. 7 PRIOR ART
FIG. 7 is an illustration of a prior art riding habit.
Figure 8:
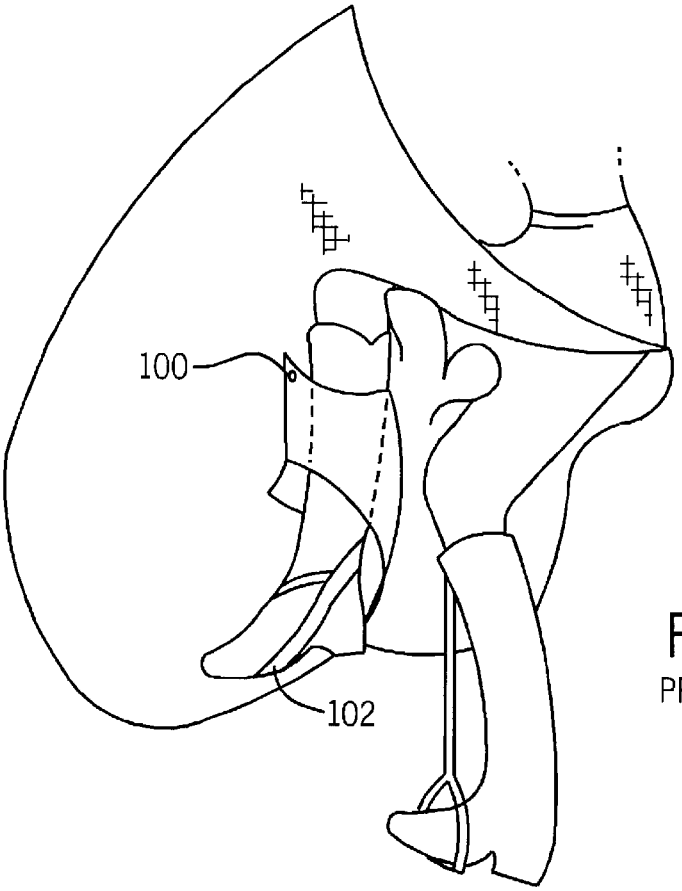
FIG. 8 PRIOR ART
FIG. 8 is an illustration of a prior art riding apron.

By comparison, two prior art examples are shown in FIGS. 7 and 8. FIG. 7 shows a prior art riding habit including two stirrups "V" for the rider's feet and a flap "O" for the right leg. The flap o is buttoned around the leg. The skirt, therefore, is closely tied to the leg of the rider. FIG. 8 shows a prior art riding apron. One corner of the apron includes a buttonhole 100. The skirt is folded around the leg and secured in place by a long elastic strap 102 that is wrapped through the fold and over the foot. Again, the right leg of the rider is closely secured to the skirt.

Referring now to FIG. 9, the proper positioning of the apron skirt 10 while the rider is mounted is shown. The combination of the strap 18 and knee loop 20 maintains the long front skirt 12 over the right leg of the rider while mounted, thereby preventing the skirt from "flying up". Referring now to FIG. 10, the riding apron 10 of the present invention is shown after dismount. For walking, the strap 18 can be looped through the belt 16, thereby covering the posterior of the rider and preventing the rider from tripping over the long skirt section 12.

Although a preferred embodiment of the riding apron of the present invention has been shown and described, it will be apparent to those of ordinary skill in the art that the described features could be modified in a number of ways without departing from the invention. Furthermore, the described means for coupling the skirt to the rider's leg can be disassociated from the means for adjusting the waist of the skirt. Furthermore, the adjustability features of the invention and the coupling features can be used on a full riding habit, as well as on the described riding apron.

I claim:

1. A side saddle riding habit comprising:

an apron including a knee dart;

a knee loop coupled near the knee dart on an internal side of the apron;

a strap coupled to the internal side of the apron, the strap being selectively removably coupled to a rider's leg and through the knee loop to prevent the apron from flying up while riding, or removably coupled through a belt of the apron to allow the rider to walk.

2. The side saddle riding habit as defined in claim 1, wherein the knee loop comprises an elastic material.

3. The side saddle riding habit as defined in claim 1, wherein the strap includes a fastener for removably coupling the strap to the knee loop.

4. The side saddle riding habit as defined in claim 3, wherein the fastener comprises a hook and loop type fastener.

5. The side saddle riding habit as defined in claim 1, further comprising an adjustable belt.

6. The side saddle riding habit as defined in claim 5, wherein the adjustable belt further comprises a slide adjuster.

7. The adjustable side saddle riding habit as defined in claim 8, further comprising a belt buckle.

8. The side saddle riding habit as defined in claim 1, further comprising a fold over section, wherein the fold over section provides an adjustment in the length of the waist of the apron.

9. The side saddle riding habit as defined in claim 1, wherein the strap includes a fastener for removably coupling the strap to the belt.

10. An adjustable side saddle riding habit comprising:

an apron; and an adjustable belt including a plurality of holes, a belt strap, and a belt buckle; and a fold over section, wherein the holes in the belt are aligned with the holes in the fold over section, the belt strap is fed through the holes, and the belt strap is secured by the belt buckle.

11. The adjustable side saddle riding habit as defined in claim 10, further comprising a slide adjuster coupled to the belt to further adjust the size of the side saddle riding habit.

12. The adjustable side saddle riding habit as defined in claim 6, further comprising a knee loop which is coupled to one of a plurality of positions in a knee dart of the apron to adjust the apron to the size of the rider.

13. An adjustable side saddle riding habit comprising:

a long skirt section comprising:

a first belt section, wherein the first belt section includes an adjustable strap and a plurality of holes;

a fold over section for sizing the skirt to the rider;

a knee dart;

a knee loop coupled to an internal side of the skirt near the knee dart;

a strap, coupled to an edge of the skirt near a hem; and a removable fastener, coupled to the strap; and a short back section coupled to the front skirt section, the short back section comprising:

a second belt section including a slide fastener and a belt buckle, the belt buckle interacting with the second belt section, the first belt section, and the fold over section to adjust the size of the skirt; and a slide fastener interacting with the adjustable strap to further adjust the size of the skirt.

14. The adjustable side saddle riding habit as defined in claim 13, wherein the strap comprises an elastic material.

15. The adjustable side saddle riding habit as defined in claim 13, wherein the removable fastener is a hook and loop type fastener.

16. The adjustable side saddle riding habit as defined in claim 13, wherein the removable fastener comprises a button and buttonhole.

17. The adjustable side saddle riding habit is defined in claim 13, wherein the knee loop comprises an elastic material.

18. A method maintaining a side saddle riding habit against the leg of a rider while riding, the method comprising the following steps:

coupling a knee loop to a knee pocket of an apron;

coupling a strap near a hem and near an inside edge of the riding apron;

removably coupling the strap to the rider's leg and to the knee loop while riding.

19. The method as defined in claim 18, further comprising the step of removably coupling the strap to a belt of the apron while walking.

20. The method as defined in claim 18, further comprising the step of adjusting the position of the knee loop based on the height of the rider.

21. The method as defined in claim 17, further comprising the step of adjusting the length of the waist of the skirt with an adjustable belt and a fold over section.

* * * * *